United States Patent [19]

Fulcher

[11] 4,442,919

[45] Apr. 17, 1984

[54] PORTABLE TOWER

[76] Inventor: Rodney D. Fulcher, 2039 Brookhollow, Abilene, Tex. 79605

[21] Appl. No.: 524,461

[22] Filed: Aug. 17, 1983

Related U.S. Application Data

[63] Continuation of Ser. No. 291,562, Aug. 10, 1981, abandoned.

[51] Int. Cl.[3] ..... E04G 1/00

[52] U.S. Cl. ..... 182/63; 182/127; 182/16; 182/17; 182/115

[58] Field of Search ..... 182/63, 20, 127, 68, 182/116, 16, 17, 12, 115; 52/116, 117, 119

[56] References Cited

U.S. PATENT DOCUMENTS

| | | | |
|---|---|---|---|
| 2,074,427 | 3/1937 | Presley et al. | 189/16 |
| 2,268,796 | 1/1942 | Brauer | 189/15 |
| 2,551,286 | 5/1947 | Poetker | 182/63 |
| 2,703,634 | 3/1955 | Lee | 189/11 |
| 2,757,755 | 8/1956 | White | 52/119 |
| 2,847,097 | 8/1958 | Moore | 189/11 |
| 2,990,764 | 7/1961 | Wilder | 182/127 |
| 3,009,546 | 11/1961 | Anderson, Sr. et al. | 189/14 |
| 3,194,411 | 7/1965 | Durand | 212/46 |
| 3,473,627 | 10/1969 | Repka | 182/179 |
| 3,547,224 | 12/1970 | Watts | 182/179 |
| 4,231,200 | 11/1980 | Henderson | 52/111 |

FOREIGN PATENT DOCUMENTS

| | | | |
|---|---|---|---|
| 1569470 | 5/1969 | France | 182/116 |
| 419551 | 3/1967 | Switzerland | 182/16 |

*Primary Examiner*—Reinaldo P. Machado
*Assistant Examiner*—Alvin Chin-Shue
*Attorney, Agent, or Firm*—Hubbard, Thurman, Turner & Tucker

[57] ABSTRACT

A portable tower or derrick which may be easily towed to a selected location and then erected by a single operator. While in the transporting position, the lower portion of the portable tower is supported by wheel assemblies mounted on at least two of the tower support legs. A pivoting tongue assembly is affixed to the tower at one end and may be coupled to a vehicle at the other end. The tongue assembly serves to support the upper portion of the tower during horizontal transport. A winch or other mechanical means is utilized to erect the tower by controlling the pivotal motion of the tower about the end of the tongue assembly. Once erected, horizontal sections of the tongue assembly may be utilized to ascend the tower.

8 Claims, 4 Drawing Figures

PORTABLE TOWER

This appliclation is a continuation of application Ser. No. 291,562 filed Aug. 10, 1981, and which has been abandoned on Aug. 17, 1983.

BACKGROUND OF THE INVENTION

This invention relates to portable towers or derricks in general and more particularly to portable towers or derricks which may be easily transported and erected.

There has long been a requirement for a portable, easily erected tower or derrick in industry, the military and the recreational field. Towers or derricks of the type disclosed herein will find wide application in the oil industry, both as drilling platforms and repair platforms. Military/industrial applications of such towers will include guard towers, observation decks, water and fuel storage or as a communication equipment base. Additionally, recreational utilization of such towers as shooting platforms or blinds, or lifeguard towers are but a few of the many applications for a portable tower or derrick which may be quickly and easily erected.

Prior art solutions to the requirement for portable towers or derricks have, in general, been bulky complex mechanisms which require a great deal of skill and mechanical knowledge to erect. Such known portable towers also typically require a substantial number of men to operate, and lack the simplicity of design and operation which characterizes the present invention.

SUMMARY OF THE INVENTION

It is therefore one object of the present invention to provide a portable tower which is adapted to be towed behind a common vehicle.

It is another object of the present invention to provide a portable tower which is designed to permit erection by a single person.

It is yet another object of the present invention to provide a simple design for a portable tower in order to permit easy construction thereof.

The foregoing objects are achieved as is now described. A tower is constructed with a plurality of support legs. At least two of the support legs have wheel assemblies mounted near the base. A pivoting tongue assembly is mounted at one end to the tower and is adapted at the other end to be coupled to a vehicle. A winch or other means is utilized to raise the tower from the transport position, resting upon the tongue assembly and the wheel assemblies, to the upright position. Once erected, horizontal members of the tongue assembly form a ladder to assist in ascension of the tower.

BRIEF DESCRIPTION OF THE DRAWINGS

The novel features believed characteristic of the invention are set forth in the appended claims. The invention itself; however, as well as a preferred mode of use, further objects and advantages thereof, will best be understood by reference to the following detailed description of an illustrative embodiment when read in conjunction with the accompanying drawings, wherein:

DETAILED DESCRIPTION OF THE INVENTION

Figure 1:
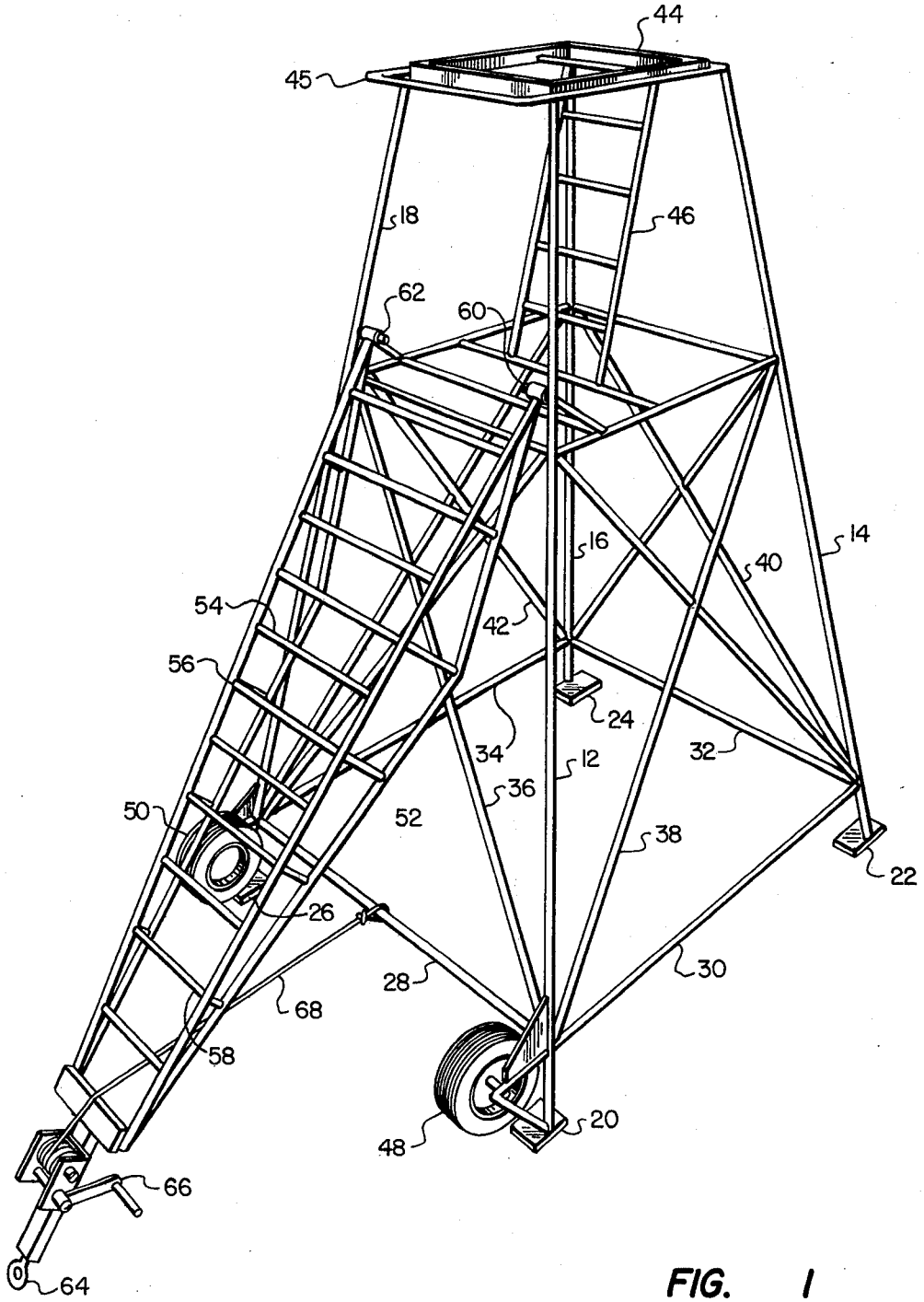
FIG. 1 is a perspective view of the portable tower of the present invention.

With reference now to the figures, and in particular to FIG. 1, there is depicted a perspective view of the fully erected portable tower of the present invention. The disclosed embodiment of the portable tower is a four legged structure, supported while erect by support legs 12, 14, 16 and 18 and support feet 20, 22, 24 and 26. Those skilled in the art will appreciate that alternate embodiments of the present invention may utilize a fewer or greater number of support legs. The support legs are, in a preferred embodiment, constructed of standard steel pipe; however, in alternate utilizations, the tower of the present invention may be constructed of other material including wood, fiberglass or metallic substances.

Cross braces and supports 28, 30, 32 and 34 as well as 36, 38, 40 and 42 are utilized to provide the necessary strength and rigidity for the tower, and the placement number, and type of cross bracing utilized are design choices which will depend upon the purpose to which a particular tower will be put.

Platform 44 is mounted atop the portable tower of the present invention. Platform 44 may be easily modified to receive various storage tanks, electronic equipment or support platforms for the multitude of uses to which the portable tower of the present invention may be put. Striker bar 45 is extended from platform 44 and is utilized to support the tower during transport as will be discussed below. Ladder 46 is depicted leading from the intermediate level of the tower to platform 44. A trap door in the lower section of a shooting blind would permit excellent access via ladder 46.

Wheel assemblies 48 and 50 are depicted mounted to support legs 12 and 18. In the disclosed embodiment, wheel assemblies 48 and 50 do not contact the ground while the tower is erect. The mounting method depicted is thought to provide a more stable structure than one in which the wheel assemblies are in contact with the ground; however, the placement of wheel assemblies 48 and 50 is also a matter of design choice. A mechanical brake assembly, effective to prevent wheel assemblies 48 and 50 from rolling, may also be included in alternate embodiments to provide additional stability.

Tongue assembly 52 is constructed with a truss design to support the weight of the tower, while in the transport position. Horizontal braces, such as those numbered 54, 56 and 58 serve a two fold purpose. In addition to providing strength and rigidity to tongue assembly 52, such horizontal braces also serve as a ladder to permit ascent of the tower.

The upper end of tongue assembly 52 is privotally mounted to the tower by means of pivot mounts 60 and 62, and the lower end of tongue assembly 52 includes a pintle ring hitch 64. In an alternate embodiment, a ball hitch and pivoting tongue may be substituted for the pintle ring hitch 64; however, the preferred embodiment of the present invention utilizes a pintle ring hitch in order to permit pivotal mounting.

A hand operated winch 66 is depicted as mounted to tongue assembly 52 near pintle ring hitch 64. Winch 66 may also be mounted upon the vehicle utilized to tow the tower of the present invention, with no deviation from the inventive concept expressed herein. A guy wire 68 is attached to winch 66 at one end and may be attached to any structural element of the tower at the other end.

Figure 2:
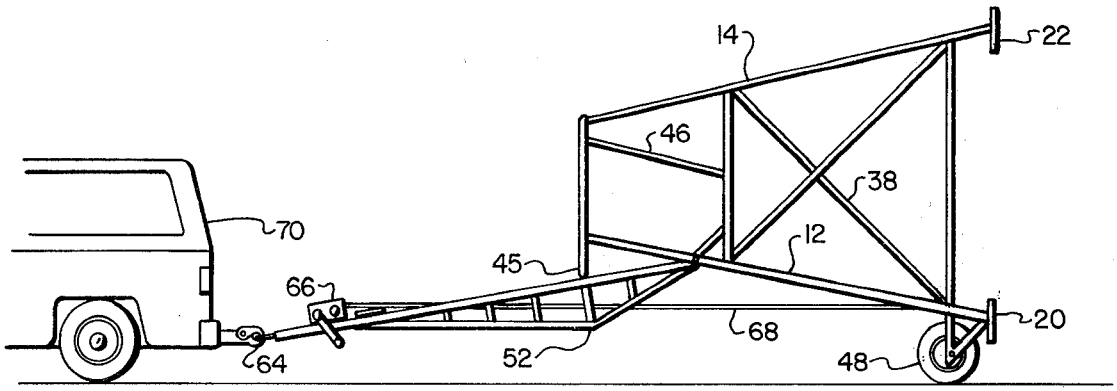
FIG. 2 is a side view of the portable tower of the present invention, configured for trailering.

With reference now to FIG. 2, there is depicted a side view of the portable tower of the present invention, in the transport position. Pintle ring hitch 64 is shown hitched to a vehicle 70. Striker bar 45 is supported by tongue assembly 52. Those skilled in the art will appreciate that tongue assembly 52 is depicted with a truss design to withstand the strain of supporting the tower while in this configuration. The tower is thus supported by tongue assembly 52 and wheel assemblies 48 and 50 and may be easily transported to the site of erection.

Figure 3:
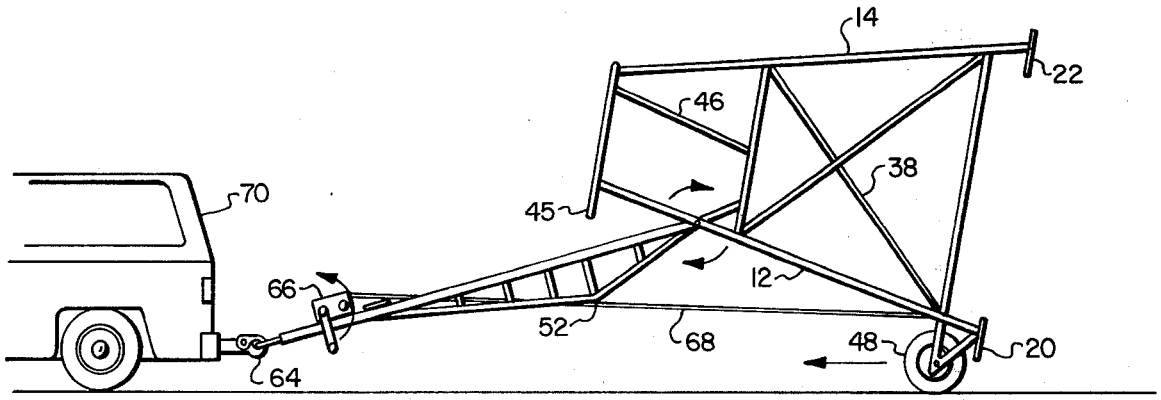
FIG. 3 is a side view of the portable tower of the present invention being erected.

Referring now to FIG. 3, the means by which the tower is erected is depicted. Guy wire 68 is attached to cross brace 28 (see FIG. 1) and winch 66 is operated to reel in guy wire 68. This action will cause the tower to pivot about pivot mounts 60 and 62 (see FIG. 1). As guy wire 68 is reeled in by winch 66, wheel assemblies 48 and 50 are drawn towards vehicle 70 and the tower moves toward the erect position. At the point where support feet 20 and 26 are in contact with the ground, vehicle 70 is then backed up slowly until support feet 22 and 24 are in contact with the ground.

Figure 4:
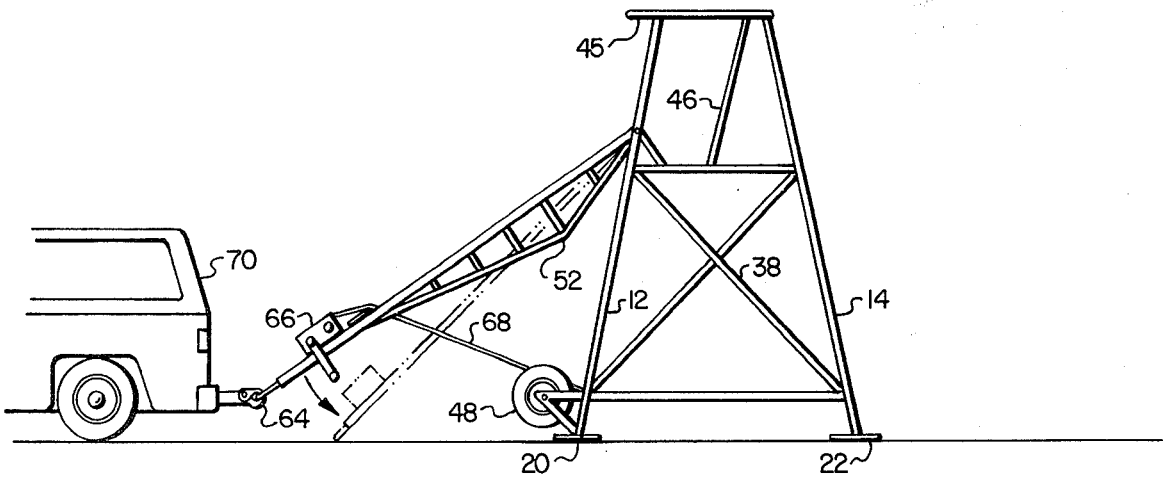
FIG. 4 is a side view of the portable tower of the present invention fully erected.

Finally, as depicted in FIG. 4, the tower is fully erect. Tongue assembly 52 may be removed from the vehicle and lowered to the ground to serve as an aid in ascent of the tower.

To return the tower to the transport position, guy wire 68 may be attached to striker bar 45 in order to lift tongue assembly 52 to a sufficient height to engage the hitch on vehicle 70. After vehicle 70 is hitched to tongue assembly 52, guy wire 62 is payed out to a predetermined length, wholly dependent upon the size of the tower involved, and reattached to cross brace 28. Vehicle 70 is then driven forward until wheel assemblies 48 and 50 are again in contact with the ground. Guy wire 68 will prevent the tower from falling completely over. Winch 66 may then be utilized to lower the tower until striker bar 45 once again engages tongue assembly 52 in the transport position.

In the manner described above, a single operator may erect and remove the portable tower of the present invention. The tower may also be freely moved from one site to another utilizing the method described herein.

Although the invention has been described with reference to a specific embodiment, this description is not meant to be construed in a limiting sense. Various modifications of the disclosed embodiment as well as alternative embodiments of the invention will become apparent to persons skilled in the art upon reference to the description of the invention. It is therefore comtemplated that the appended claims will cover any such modifications or embodiments that fall within the true scope of the invention.

What is claimed is:

1. A portable tower for transport between erection sites behind a tow vehicle, said tower comprising:

a tower assembly including support leg means for supporting said tower in an erect position, said support leg means including means at a base of said support leg means for engagement with the ground when said tower is in said erect position;

tower transport wheels mounted on said tower assembly at substantially the end of said tower including said base of said support leg means; and an elongated tongue assembly pivotally connected at one end of said tongue assembly to said tower assembly at a pivot point on said tower assembly which is spaced from and above the axes of rotation of said transport wheels when said tower is in said erect position, said tongue assembly including means at its other end for coupling said tongue assembly to said tow vehicle for towing said tower in a substantially reclined transport position, said tower assembly including means engageable with said tongue assembly upon movement of said tower assembly to said transport position from said erect position whereby said tower assembly is supported in said transport position by said tongue assembly and said transport wheels and whereby said tongue assembly is supported by and between said tow vehicle and said tower assembly during transport of said tower, the spacing of said pivot point in relation to the axes of rotation of said transport wheels being sufficient to provide for movement of said tower assembly toward said erect position by exerting a tower erecting force on said tongue assembly to pivot said tower about said pivot point and with respect to said tongue assembly to said erect position.

2. The portable tower according to claim 1 including:

control means operably connected to said tower assembly for moving said tower assembly between said erect position and said transport position.

3. The portable tower according to claim 2 wherein:

said control means includes an extensible and retractable member being operably connected at one end to said tongue assembly at a point spaced from said pivot point, said extensible and retractable member being operably connected to said tower assembly at a point between said pivot point and said base of said support leg means for moving said tower assembly with respect to said tongue assembly at least partially between said erect position and said transport position by pivoting said tower assembly with respect to said tongue assembly about said pivot point.

4. The portable tower set forth in claim 3 wherein:

said control means comprises a winch mounted on said tongue assembly adjacent said other end, and a guy wire operably connected to said winch and to said tower assembly at said point between said pivot point and said base of said support leg means.

5. The portable tower set forth in claim 1 wherein:

said lower assembly includes platform means formed thereon and said tongue assembly includes a plurlity of spaced apart horizontally extending members thereon forming ladder means for ascending to or descending from said platform means when said tower assembly is in said erect position.

6. A portable tower for transport between erection sites behind a tow vehicle, said tower comprising:

a tower assembly having a plurality of spaced apart support legs for supporting said tower in an erect position, said support legs including support means at a base of each of said support legs, respectively, for engagement with the ground when said tower is in said erect position;

tower transport wheels mounted on said tower assembly at substantially the end of said tower assembly including said support means;

an elongated tongue assembly pivotally connected at one end of said tongue assembly to said tower assembly at a pivot point on said tower assembly which is spaced from and above the axes of rotation of said transport wheels when said tower is in said erect position, said tongue assembly including means at its other end for coupling said tongue assembly to said tow vehicle for towing said tower in a transport position wherein said tower assembly is supported by said tongue assembly and said transport wheels and said tongue assembly is supported between said tow vehicle and said tower assembly; and means operably interconnecting said tongue assembly and said tower assembly for moving said tower assembly relative to said tongue assembly at least partially from said transport position toward said erect position, and the spacing of said pivot point in relation to the axes of rotation of said transport wheels providing for movement of said tower assembly relative to said tongue assembly further toward said erect position when said support means are engaged with the ground by urging said tower assembly by a force exerted on said tongue assembly.

7. A portable tower for transport between erection sites behind a tow vehicle, said tower comprising:

a tower assembly having a plurality of spaced apart support legs for supporting said tower in an erect position, said support legs including tower support means at the base of said support legs, respectively, for engagement with the ground to support said tower in said erect position;

tower transport wheels mounted on wheel support means disposed on said tower assembly adjacent the end of said tower assembly including said support means, said wheel support means supporting said wheels in an elevated position with respect to the ground when said tower is in said erect position and supported by said support legs; and an elongated tongue assembly pivotally connected at one end of said tongue assembly to said tower assembly at a pivot point which is spaced from and above the axes of rotation of said transport wheels when said tower is in said erect position, said tongue assembly including means at its other end for coupling said tongue assembly to said tow vehicle for towing said tower between erection sites in a transport position, said tower assembly including means engageable with said tongue assembly in said transport postion whereby said tower assembly is supported by said tongue assembly and said transport wheels, said tongue assembly being supported by and between said tower assembly and said tow vehicle during transport of said tower, and said tower is movable between said transport position and said erect position by pivotal movement of said tower assembly relative to said tongue assembly while said tongue assembly is connected to said towing vehicle.

8. The portable tower set forth in claim 7 wherein:

said tower assembly has four support legs, two of said support legs being engageable with the ground for supporting said tower assembly during a portion of movement of said tower assembly to said erect position whereby said tower assembly is urged toward said erect position by a force exerted on said tongue assembly to pivot said tower assembly about the point of engagement of said two legs with the ground.

* * * * *